US006651333B2

(12) United States Patent
Letrange et al.

(10) Patent No.: US 6,651,333 B2
(45) Date of Patent: Nov. 25, 2003

(54) ALUMINUM BASED COLLARED HEADER PLATE FOR A HEAT EXCHANGER, ESPECIALLY FOR A MOTOR VEHICLE

(75) Inventors: Frédéric Letrange, Nanterre (FR); Carlos Martins, Montfort l'Amaury (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 10/151,884

(22) Filed: May 22, 2002

(65) Prior Publication Data

US 2002/0139521 A1 Oct. 3, 2002

Related U.S. Application Data

(62) Division of application No. 08/918,439, filed on Aug. 28, 1997.

(30) Foreign Application Priority Data

Aug. 29, 1996 (FR) ..... 96 10573

(51) Int. Cl.[7] ..... B23P 15/26
(52) U.S. Cl. ..... 29/890.052; 29/890.054
(58) Field of Search ..... 29/890.052, 890.054, 29/428; 72/326, 327, 333, 330, 334, 347; 165/133, 134.1, 173, 905

(56) References Cited

U.S. PATENT DOCUMENTS

| | | | | |
|---|---|---|---|---|
| 1,695,476 A | * | 12/1928 | Winkler | 72/334 |
| 1,959,101 A | * | 5/1934 | Hasselquist | 72/327 |
| 3,111,977 A | * | 11/1963 | Krüger | 72/326 |
| 3,245,465 A | * | 4/1966 | Young | 165/148 |
| 3,460,368 A | * | 8/1969 | Brown | 72/334 |
| 3,891,400 A | | 6/1975 | Robinson | 29/197.5 |
| 4,146,163 A | | 3/1979 | Anderson et al. | 228/158 |
| 4,150,556 A | * | 4/1979 | Melnyk | 72/333 |
| 4,234,041 A | | 11/1980 | Melnyk | 165/173 |

(List continued on next page.)

FOREIGN PATENT DOCUMENTS

| | | |
|---|---|---|
| DE | 33 16960 | 11/1983 |
| DE | 4129573 | 3/1993 |
| FR | 2 231 932 | 12/1974 |
| FR | 2 538 526 | 6/1984 |
| GB | 1 454 316 | 11/1976 |
| JP | 60 251 243 | 12/1985 |
| JP | 05 065 582 | 3/1993 |
| JP | 07 305 992 | 11/1995 |

OTHER PUBLICATIONS

French Search Report dated May 9, 1997.

English Abstract of JP 60 251 243.

English Abstract of JP 05 065 582.

*Primary Examiner*—I Cuda-Rosenbaum
(74) *Attorney, Agent, or Firm*—Morgan & Finnegan

(57) ABSTRACT

An aluminum based header plate, for a tubular heat exchanger for a motor vehicle, has an external coating on its outer face. An end portion of each heat exchanger tube is received in a corresponding through hole in the header plate. The tube end portions have a predetermined cross section and an external coating, and secured to the header plate by brazing. Each through hole is made by a slitting operation followed by configuration of the through hole within a selected zone of the header plate, this zone being press-formed so as to form in the outer face of the header plate a collar portion in that zone. The internal transverse cross section of each collar portion is substantially identical to the predetermined cross section of the corresponding tube end portion. After the tube has been introduced into the through hole, which extends through the collar portion, there is surface contact between the respective external coatings of the collar portion and of the tube end portion.

14 Claims, 2 Drawing Sheets

U.S. PATENT DOCUMENTS

| | | | | |
|---|---|---|---|---|
| 4,582,127 | A | | 4/1986 | Moranne ..... 165/83 |
| 4,615,385 | A | | 10/1986 | Saperstein et al. ..... 165/175 |
| 4,722,387 | A | | 2/1988 | Aurand ..... 165/153 |
| 4,730,669 | A | | 3/1988 | Beasley et al. ..... 165/151 |
| 4,732,311 | A | | 3/1988 | Hasegawa et al. ..... 228/138 |
| 4,759,405 | A | | 7/1988 | Metzger ..... 165/173 |
| 4,825,941 | A | | 5/1989 | Hoshino et al. ..... 165/110 |
| 4,991,647 | A | | 2/1991 | Kawabe et al. ..... 165/134 |
| 5,009,095 | A | * | 4/1991 | Voss ..... 72/335 |
| 5,069,980 | A | | 12/1991 | Namba et al. ..... 428/654 |
| 5,292,595 | A | | 3/1994 | Yamauchi et al. ..... 428/654 |
| 5,422,191 | A | | 6/1995 | Childree ..... 428/654 |
| 5,720,340 | A | | 2/1998 | Ohara et al. ..... 165/133 |
| 2002/0005057 | A1 | * | 1/2002 | Hidaka et al. ..... 72/333 |

* cited by examiner

ALUMINUM BASED COLLARED HEADER PLATE FOR A HEAT EXCHANGER, ESPECIALLY FOR A MOTOR VEHICLE

This is a Division of application Ser. No. 08/918,439 filed on Aug. 28, 1997.

FIELD OF THE INVENTION

This invention relates to heat exchangers, especially for motor vehicles. More particularly, the invention relates to header plates for such heat exchangers, where the header plate is of an aluminum based material and has an outer surface covered with an external coating, and a plurality of through holes, each of which is adapted to receive an end portion of a heat exchanger tube, the tube end portion having a predetermined cross section and having a further external coating.

BACKGROUND OF THE INVENTION

At the present time, in such aluminum based header plates, the tubes are secured to the header plate, in the region of the through holes in the latter, by welding or brazing. The through holes in this type of header plate are generally made by a press-forming operation which involves removal of some material. The contact between the end portion of a tube, having an external coating, and the header plate, is consequently obtained over the periphery of the through hole into which the tube end portion is introduced. This contact accordingly occurs in the thickness of the wall of the header plate, that is to say precisely in the region where the latter, as a result of the pressing-out operation, no longer has a reliable coating.

The result of this is that the brazed or welded joint between each tube and the corresponding through hole in the header plate gives less than perfect sealing. This can later give rise to leakage and corrosion problems, the consequences of which can be serious.

In addition, because of weight and size limitations which are encountered in the engine compartments of current vehicles, manufacturers are obliged to make use of light and thin materials. Now, thin materials such as are used at the present time do not always have the required mechanical strength characteristics, in particular as regards ability to withstand pressure cycling.

In order to overcome this disadvantage, some header plates are made of an alloy of aluminum and magnesium, which has a better mechanical strength than that of pure aluminum. However, it has become apparent that during the brazing operation some of the magnesium tends to diffuse towards the brazed joint, thus reducing the ability of the surfaces to be brazed together to be wetted. This results in a significant reduction in the effectiveness of sealing in the brazed joint, and this, again, can give rise to leakage and accelerated corrosion.

DISCUSSION OF THE INVENTION

An object of the invention is to provide a header plate of aluminum based material, of the general kind defined in "Field of the Invention" above, which does not have the above mentioned drawbacks.

According to the invention in a first aspect, a header plate of aluminum based material for a heat exchanger, especially for a motor vehicle, the said header plate having an outer surface coated with an external coating, and further having a multiplicity of through holes, each of which is adapted to receive an end portion of a heat exchanger tube of predefined cross section, clad on the outside with an external coating, is characterised in that each through hole is formed by slitting a selected zone of the header plate followed by a configuring operation, the said zone being deformed by press-forming in such a way that the outer surface of the header plate bounds, in the said zone, a collar portion having an internal transverse cross section which is substantially identical to the predefined cross section of the corresponding said tube end portion, so that after introduction of the tube into the through hole in the collar portion, a surface contact is obtained between the respective external coatings of the collar portion and the tube end portion.

In this specification, the term "slitting" is to be taken to mean the particular form of piercing that does not involve removal of any material. In the context of the present invention, this slitting operation facilitates the formation of the collar portion, thus enabling an excellent seal to be obtained by brazing.

Preferably, the external coatings of the header plate and tube end portions are of an alloy of aluminum and silicon.

Preferably, the inner face of the header plate, which is opposed to its outer face, is covered with an internal coating which may for example be an alloy of aluminum and zinc, the anti-corrosive properties of which are well known. This enhances the protection of the heat exchanger against corrosion.

In a preferred embodiment of the invention, the header plate is made in an alloy of aluminum and magnesium, the percentage of magenesium being preferably greater than 2%. This leads to a substantial improvement in the mechanical strength of the header plate as compared with a header plate made of pure aluminum.

According to another feature of the invention, an intermediate coating is provided between the outer face of the header plate and its external coating, this intermediate coating being for example in an alloy of aluminum and zinc. The intermediate coating restricts, and can even totally prevent, the diffusion of magnesium towards the external coating, and therefore helps to improve even more the quality of the seal given by the brazed joint.

In a second aspect of the invention, a method of forming the through holes in a header plate according to the said first aspect of the invention is characterised in that it comprises the following steps:

(a) providing a tool which comprises: a punch having a sharp end portion extended by a body having a transverse cross section substantially identical to that of a said tube end portion; and a die formed with at least one die hole having a cross section substantially equal to the transverse cross section of the body of the corresponding punch added to the thickness of the header plate;

(b) locating the die in facing relationship with an inner surface of the header plate, opposed to its outer surface, so that the said die hole lies above a selected zone of the header plate, and then applying the sharp end portion of the punch on the outer surface of the header plate in the selected zone, so as to cause the internal surface of the header plate to penetrate into the die hole; and (c) slitting the said zone so as to rough form a through hole and to cause the material of the header plate, bounding the said through hole, to penetrate into the die hole, so that a collar portion is formed, and then causing the body of the said punch to slide within the corresponding die hole, so that the collar portion and the associated through hole have an internal transverse cross section which is identical to the predefined cross section of the end portion of a tube which is to be fixed in the through hole of the header plate.

According to a preferred feature of the method of the invention, the slitting operation consists of a piercing operation without any removal of material, so as not to damage the external coating in the region of the through holes in the header plate.

Preferably, the method also includes a further step (a') between steps (a) and (b), in which step (a') comprises press-forming the selected zone, firstly on the side of the outer surface of the header plate so as to form on the said inner surface a first offset portion in relief, having dimensions substantially equal to those of the body of the punch, and then, secondly, on the same side as the inner surface of the header plate, so as to form on the said outer surface a second offset portion in relief surrounding at least part of the first offset portion.

Further features and advantages of the invention will appear more clearly on a reading of the following detailed description of some preferred embodiments of the invention, which are given by way of non-limiting example only and with reference to the accompanying drawings.

DESCRIPTION OF PREFERRED EMBODIMENTS OF THE INVENTION

Figure 1A:
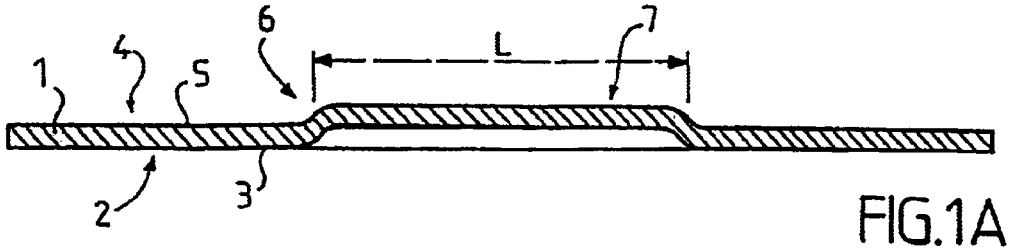
FIG. 1A shows a first step in the manufacture of a header plate in accordance with the invention, seen in longitudinal cross section.
Figure 1B:
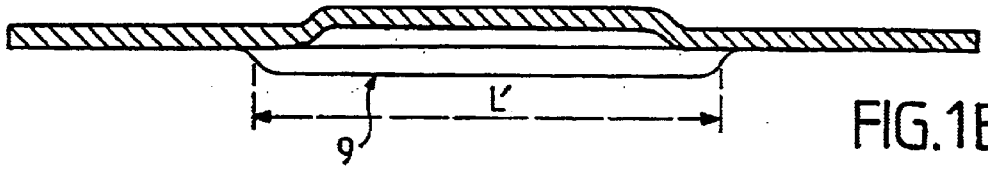
FIG. 1B shows in longitudinal cross section a second step in the manufacture of the header plate.
Figure 1C:
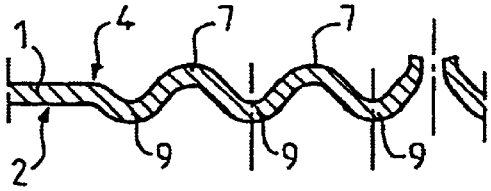
FIG. 1C shows the same second step, but in transverse cross section.

Reference is first made to FIGS. 1A to 1E, and FIG. 2. The main steps in a method of forming holes in an aluminum based header plate will be described with reference to these Figures.

The starting point for making the header plate is a substantially flat plate 1, of aluminum or an aluminum alloy. The outer face 2 of the plate has an external coating 3, which is preferably of an alloy of aluminum and silicon. Preferably the inner face 4 is also coated, in this case with an anti-corrosion material such as an aluminum zinc alloy.

Using an appropriate machine tool, a central portion 6 of the plate 1 is then press-formed so as to create in this central zone a first offset portion, or blister, 7, which is in relief on the same side as the inner face 4 of the plate. This first blister 7 has dimensions which are substantially equal to the dimensions of the end portion 8 of a heat exchanger tube (see FIG. 3) and the dimensions of a punch shown in FIG. 2. This punch is used for forming through holes in the plate 1. Further reference will be made to these holes later in this description. The first offset portion or blister 7 is substantially oval in form, having a major or longitudinal side L and a minor or transverse side I. This first offset portion is seen in longitudinal cross section in FIG. 1A.

The next step, shown in FIGS. 1B and 1C, is again a press-forming step, in which a second offset portion 9 is formed, this time in relief on the outer face 2 of the plate 1. The second offset portion surrounds at least part of the first offset portion 7, so as to form two grooves, at least on the longitudinal sides L of the offset portion 7. The groove that lies between two parallel blisters 7 adjacent to each other does of course constitute a second offset portion 9 for each of the two offset portions 7 concerned. The length L' of the longitudinal extent of the second offset portion 9 is substantially greater than the length L of the portion 7.

It will of course be understood that the first and second offset portions 7 and 9 may be formed in a single step, using an appropriate machine tool.

Figure 1D:
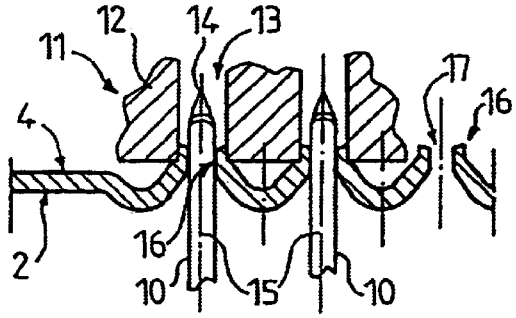
FIG. 1D shows a third step in the manufacture of the header plate, in transverse cross section.
Figure 1E:
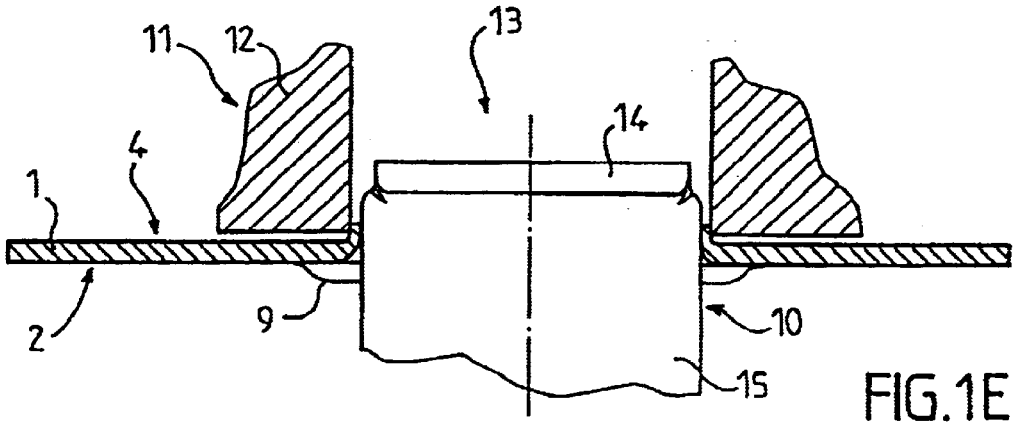
FIG. 1E shows the same third step in longitudinal cross section.
Figure 2:
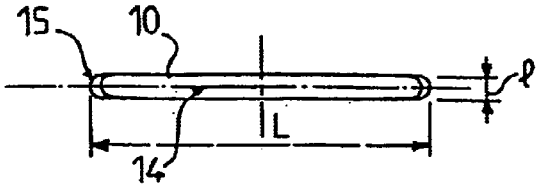
FIG. 2 is a top plan view of a punch for making the holes in a header plate according to the invention.

In the third step illustrated in FIGS. 1D and 1E, a further tool 11 is used. The tool 11 comprises at least one punch 10 (there being two of these punches in the example shown in FIG. 1D), together with a die 12 having as many die holes 13 as there are of the punches 10, with one die hole 13 corresponding to each punch 10 so that the punches 10 can slide within the die holes.

Each punch 10 has a sharp and tapered end portion 14, which is extended by a body 15 of the punch having a transverse cross section which is substantially identical to that of the first offset portion or blister 7 and to the outer transverse cross section of a tube end portion 8. In the die 12, each die hole 13 has a form which is matched in shape to that of the body 15 of the corresponding punch 10, but which is slightly larger for reasons which will be explained later in this description.

The holes 17 in the plate 1 are formed in the following way. The die 10 of the tool 11 is first positioned in such a way that each of its die holes 13 lies above a corresponding one of the first offset portions 7 and in contact with the inner face 4 of the plate 1. The punches 10 are then displaced substantially at right angles to the plane defined by the plate 1, and parallel to the axes of the die holes 13, until the respective end portions 14 of the punches make contact with the profiled outer face 2 of the plate at the locations of the first offset portions 7. The plate 1 is then slit by means of the sharp ends 14 of the punches without removing any material, thereby rough forming the through holes 17.

The body 15 of each punch 10 is then forced through the rough-formed opening, and the punch continues to be moved so as to slide within the die hole 13 (as can be seen in FIGS. 1D and 1E). Because of the dimensioning of the die hole 13, some of the material of the plate 1 is carried by the punch 10 into the interior of the corresponding die hole 13, thus forming an upset collar portion 16, the dimension of which is equal to the transverse cross section of the body 15 of the punch 10. This also configures the actual hole 17, which was previously rough-formed by the slitting operation described above, to the dimensions of the punch body 15, and therefore also configures the hole 17 to the dimensions of the tube end portion 8 to be received in the hole 17.

Figure 3:
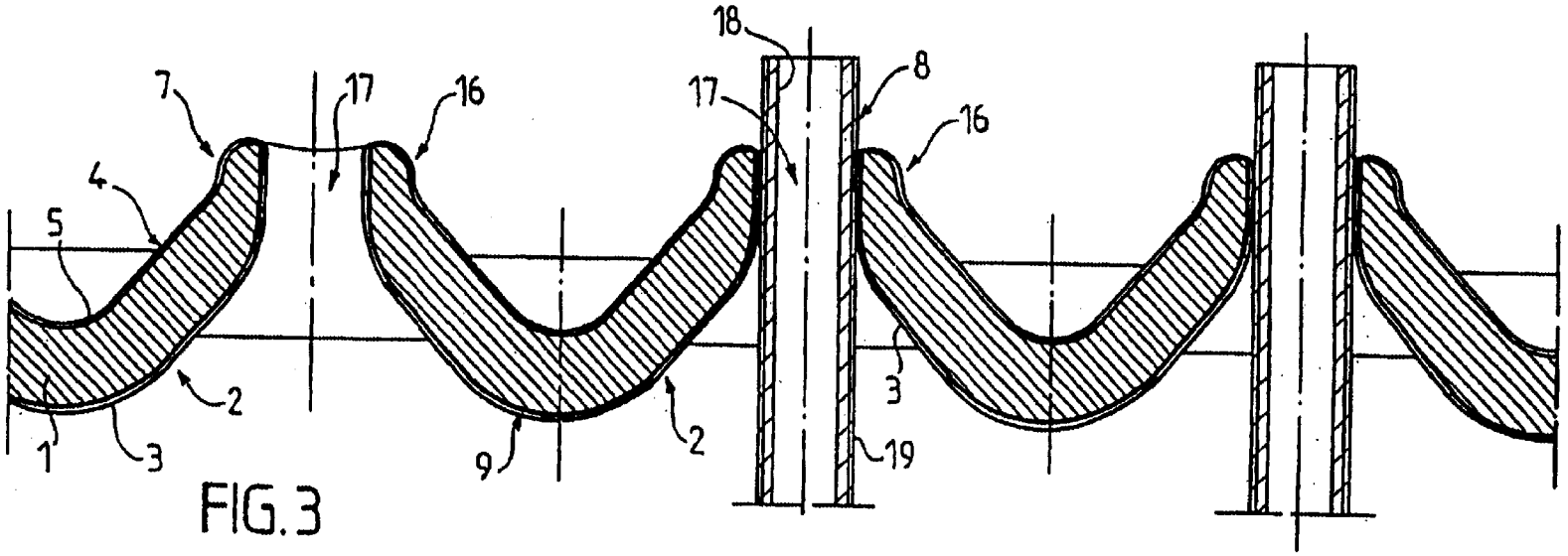
FIG. 3 shows, in transverse cross section, a first embodiment of the header plate according to the invention, equipped with heat exchanger tubes.

The central portion 6 of the header plate 1 having thus been formed with its through holes, the tube end portions 8 can now be introduced into these holes as shown in FIG. 3. Once the tube end portions have been fitted in their precisely dimensioned holes 17, surface contact is made between the external coating 3 on the outer face 2 of the header plate 1, which bounds the collar portions 16, and the external coating 19 on the tube wall 18 in the end portion 8 of the tube, see FIG. 3. This surface contact takes place over several millimeters of height, so that during the subsequent brazing step, a very good sealing joint can be obtained.

Figure 4A:
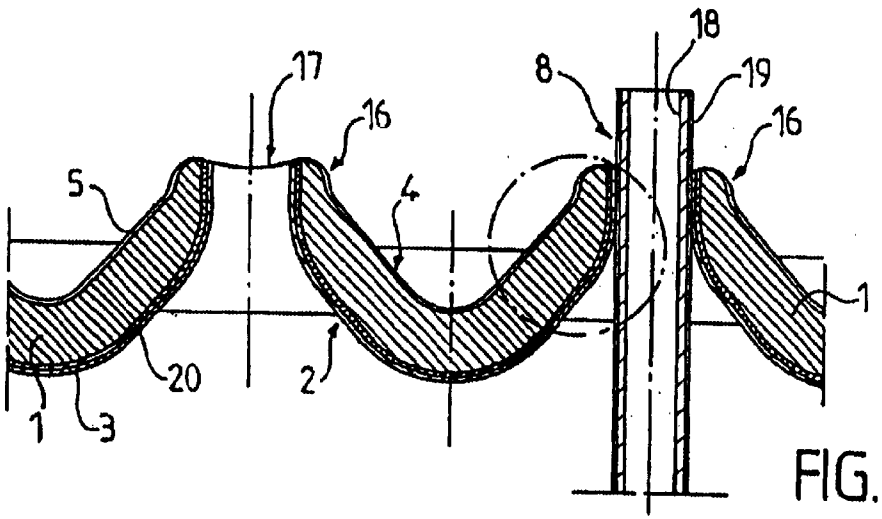
FIG. 4A shows in transverse cross section a header plate according to the invention in a second embodiment, equipped with a heat exchanger tube.
Figure 4B:
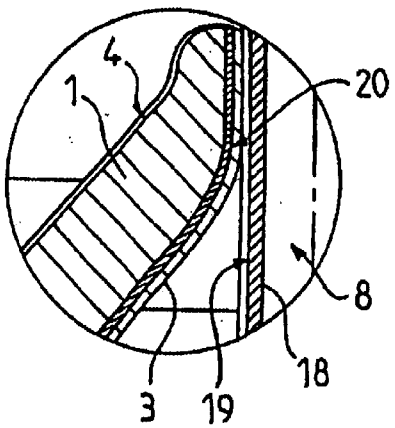
FIG. 4B is a scrap view repeating, on a larger scale, that part of FIG. 4A which is denoted by a phantom circle.

Reference is now made to FIGS. 4A and 4B, to describe another version of header plate in accordance with the invention.

Because of the comparative fragility of header plates made of pure aluminum, the latter may be made of an alloy of aluminum and magnesium. The percentage of magnesium in such an alloy is preferably greater than 2%. This type of header plate has significantly better mechanical strength than that of header plates made of pure aluminum. However, the magnesium contained in the alloy tends to diffuse during the brazing operation, in particular towards the external coating 3, and this tends to diminish the effectiveness of the seal in the brazed joint by reducing the ability of the external coating on the outer face 2 to be wetted.

Consequently, it is preferable to place, between the external coating 3 and the plate of aluminum and magnesium alloy that constitutes the header plate 1, an intermediate coating 20 of an aluminum and zinc alloy, the physical characteristics of which enable the diffusion of the magnesium towards the external coating 3 to be at least limited, and even to be fully prevented. In this way, header plates can be made with high sealing integrity, and with mechanical characteristics which enable them to withstand very high cyclic pressures.

The invention is not limited to the embodiments of header plate and methods of making it described above, but embraces all those variants which could be conceived by a person normally skilled in the art within the scope of the Claims of this Application.

Thus, for example, although a header plate has been described in which the through holes are formed after the formation of offset portions, namely, in the above example, the first offset portion 7 and the second offset portion 9, it will be understood that these offset portions, though preferred, are not in fact essential.

In addition, in the method described above, the through holes are first rough-formed by slitting without any removal of material. However, it is perfectly well possible to envisage the holes being rough-formed by slitting with some removal of material, provided that the rough-formed hole is of substantially smaller dimensions than a tube end portion, so that integral collar portions can be formed.

What is claimed is:

1. A method of making an aluminum based header plate for a heat exchanger comprising a plurality of heat exchanger tubes and a header plate, in which each heat exchanger tube has an end portion of predetermined cross section, the header plate having an outer face and an inner face, the outer face having a first external coating, the header plate further having a plurality of through holes each of which to receive a corresponding tube end portion, each tube end portion having a second external coating, the method comprising:

providing a tool including a punch and a die, the punch including a body having a transverse cross section substantially identical to that of a tube end portion, the punch body terminating in a sharp end, the die having at least one die hole with a cross section substantially equal to the transverse cross section of the corresponding punch body added to the thickness of the header plate between the outer and inner faces thereof;

press-forming at least one zone of the header plate from the same side of the header plate as its outer face, thereby forming in relief on the inner face of the header plate a first offset portion of dimensions substantially equal to those of the punch body;

press-forming, from the same side as the inner face of the header plate, a second offset portion in relief on the outer face, such that the second offset portion at least partly surrounds the first offset portion;

selecting at least one zone of the header plate for formation of a through hole;

positioning the die in facing relationship with the inner face of the header plate, with the die hole over the zone;

applying the sharp end of the punch to the outer face of the header plate in the zone so that the sharp end penetrates the inner face of the header plate in the die hole;

slitting the zone to rough-form a through hole and cause the material of the header plate bounding the through hole to penetrate into the die hole, thereby forming a collar portion;

causing the punch body to slide in the die hole so as to form an internal transverse cross section of the collar portion and the through hole bounded thereby, which is substantially identical to the predetermined cross section of a tube end portion; and fitting the tube end portion into the through hole; and securing the tube end portion to the header plate.

2. The method according to claim 1, wherein the slitting comprises performing a punching operation without removal of any material.

3. The method according to claim 1, comprising forming the first and second offset portions in a single step.

4. The method according to claim 1, further comprising providing the first and second external coatings made of at least an alloy of aluminum and silicon.

5. The method according to claim 1, further comprising providing the header plate having an inner surface opposed to the outer surface, and an internal coating covering the inner surface.

6. The method according to claim 5, further comprising providing the internal coating made of an alloy of aluminum and zinc.

7. The method according to claim 1, further comprising providing the header plate made of an alloy of aluminum and magnesium.

8. The method according to claim 7, further comprising providing the header plate made of an alloy of aluminum and magnesium containing more than 2% magnesium.

9. The method according to claim 1, further comprising providing the header plate with an intermediate coating interposed between its external surface and the first external coating.

10. The method according to claim 9, further comprising providing the header plate with the intermediate coating made of an alloy of aluminum and zinc.

11. The method according to claim 1, further comprising pre-coating the first and second external coatings respectively to the header and the tube end portion prior to selecting the zone.

12. The method according to claim 11, further comprising obtaining surface contact between the first and second external coatings when the tube end portion is fitted in the through hole.

13. The method according to claim 1, further comprising forming simultaneously a plurality of through holes and respective collar portions with the tool having a plurality of die holes and corresponding punches.

14. The method according to claim 1, wherein the securing comprises performing a brazing operation to secure the tube end portion in the through hole of the header plate.

* * * * *

UNITED STATES PATENT AND TRADEMARK OFFICE

CERTIFICATE OF CORRECTION

PATENT NO. : 6,651,333 B2 
DATED : November 25, 2003
INVENTOR(S) : Frédéric Letrange and Carlos Martins It is certified that error appears in the above-identified patent and that said Letters Patent is hereby corrected as shown below:

Title page,
Item [62], Related U.S. Application Data, please change "Division of application No. 08/918,439 filed on August 28, 1997" to -- Division of application No. 08/918,439 filed August 26, 1997 --.

Signed and Sealed this

Ninth Day of March, 2004

JON W. DUDAS
*Acting Director of the United States Patent and Trademark Office*